US006622518B2

(12) United States Patent
Park

(10) Patent No.: US 6,622,518 B2
(45) Date of Patent: Sep. 23, 2003

(54) CRYOGENIC REFRIGERATING SYSTEM

(75) Inventor: Hee-Jun Park, So-ku Incheon (KR)

(73) Assignee: Operon Co., Ltd., Kimpo (KR)

( * ) Notice: Subject to any disclaimer, the term of this patent is extended or adjusted under 35 U.S.C. 154(b) by 0 days.

(21) Appl. No.: 10/111,384

(22) PCT Filed: Oct. 5, 2001

(86) PCT No.: PCT/KR01/01667

§ 371 (c)(1),
(2), (4) Date: May 2, 2002

(87) PCT Pub. No.: WO02/29337

PCT Pub. Date: Apr. 11, 2002

(65) Prior Publication Data

US 2002/0162353 A1 Nov. 7, 2002

(30) Foreign Application Priority Data

Oct. 5, 2000 (KR) ..... 2000-0058438

(51) Int. Cl.[7] ..... F25B 1/00

(52) U.S. Cl. ..... 62/502; 62/335; 62/498; 62/612

(58) Field of Search ..... 62/500, 502, 335, 62/612, 512, 498, 114, 467

(56) References Cited

U.S. PATENT DOCUMENTS 3,733,845 A * 5/1973 Lieberman ..... 62/335
4,689,964 A 9/1987 St. Pierre
4,763,486 A * 8/1988 Forrest et al. ..... 62/175
5,161,382 A * 11/1992 Missimer ..... 62/46.1

FOREIGN PATENT DOCUMENTS

JP 2-192545 * 7/1990 ..... 62/335
JP A06-1598317 6/1994
JP A08-105660 4/1996
JP A08-165465 6/1996

* cited by examiner

*Primary Examiner*—Melvin Jones
(74) *Attorney, Agent, or Firm*—Bacon & Thomas

(57) ABSTRACT

The present invention provides a cryogenic refrigerating system for achieving ultra low temperature by sequentially obtaining low temperature through repetition of expansion and evaporation of a mixed-refrigerant in multiple stages. The refrigerating system includes a heat exchanger and a compressor between a final evaporator and a compressor. The heat exchanger causes evaporated refrigerant vapor in a suction tube for the compressor to be heated and to be drawn into the compressor, and causes the refrigerant condensed by a condenser to be supercooled. The refrigerating system includes a plurality of expansion/suction apparatuses connected with one another between the gas/liquid separator and the final evaporator.

3 Claims, 2 Drawing Sheets

CRYOGENIC REFRIGERATING SYSTEM

TECHNICAL FIELD

The present invention relates to a multi-stage expansion/suction type of cryogenic refrigerating system, wherein the Bernoulli's principle that as the flow velocity of a fluid in a tube increases, pressure exerted by the fluid in the tube decreases is applied to a refrigerating cycle system so that low temperature can be achieved in a refrigerating chamber of a refrigerator by lowering temperature and pressure of a refrigerant in multiple stages when the refrigerant flows from a high temperature side to a low temperature side.

More specifically, the present invention relates to a cryogenic refrigerating system, wherein a specific refrigeration effect thereof is increased only by one compressor in such a manner that a process of lowering pressure of a low-temperature side refrigerant by means of strong suction force in an evaporated refrigerant carrying tube generated when a liquid refrigerant is expanded and injected at a high velocity toward an inlet of a double tube is repeatedly performed in multiple stages, and thus, evaporation pressure of the refrigerant can be maintained below suction pressure of the compressor and its stability can be ensured even in case of continuous operation thereof.

BACKGROUND ART

Generally, ultra low temperature is needed for long-term preservation of tissue, cells or genes, a semiconductor fabricating process, an apparatus for inducing a superconductivity phenomenon, etc. Particularly, in case of biological materials such as cells, if they are kept at temperature of −130° C. or less that corresponds to recrystallization temperature of ice, water contained therein is not crystallized but is in amorphous state. Thus, since it is not likely that a cell membrane is destructed, the term of preservation therefore can be greatly prolonged over 10 years. Although there are various technologies for achieving such ultra low temperature, a method using a vapor compression refrigeration cycle or liquid nitrogen is widely used. In order to achieve ultra low temperature of about −135° C. to −150° C., it is necessary to employ a multi-stage cascade refrigerating cycle having three stages or more, or to use the liquid nitrogen having liquefaction temperature of −196° C. However, since the liquid nitrogen is used up only once, it is necessary to refill the liquid nitrogen for another use. Thus, its use is inconvenient and its operating cost is increased. On the other hand, in case of the multi-stage cascade refrigerating cycle, there is a problem in efficiently achieving the desired ultra low temperature. In addition, there is another problem in that an apparatus employing the multi-stage cascade refrigerating cycle is complex in its structure, and thus, failures of the apparatus frequently occur and its operating cost is also increased.

In consideration of these problems, there has been proposed a cryogenic refrigerator, which is disclosed in an article, entitled "Temperature in Refrigerating Chamber of Compressor-type Refrigerator" in *Nikkei Mechanical,* No. 496 (Dec. 23, 1996), pp. 44–45, Japan. The cryogenic refrigerator employs a two-stage cascade mixed-refrigerant refrigeration circuit (i.e., a combination of a two-stage cascade refrigeration circuit and a mixed-refrigerant circuit) for achieving lower temperature in a low-temperature side refrigeration circuit by using a high-temperature side refrigeration circuit In the two-stage cascade mixed-refrigerant refrigeration circuit, achievable temperature in a final evaporator is −155° C., and temperature obtained in the refrigerating chamber is −152° C. As schematically shown in FIG. 2, there are the two separate high- and low-temperature side refrigeration circuits which in turn are connected with each other through a cascade condenser. The cascade condenser serves as an evaporator for the high-temperature side refrigeration circuit and as a condenser for the low-temperature side refrigeration circuit. The high-temperature side refrigeration circuit is used for achievement of further lower temperature in the low-temperature side refrigeration circuit.

In particular, in order to achieve temperature of −100° C. or less, the mixed-refrigerant refrigeration circuit was employed in the low temperature side. A typical refrigerant is a mixed-refrigerant comprised of seven kinds of refrigerants such as R412A having evaporation temperature of −40° C. for the high temperature side, and R508 (mixture of R23 and R116) having evaporation temperature of −86° C., R22 having evaporation temperature of −41° C., and R14 having evaporation temperature of −128° C. for the low temperature side. The mixed-refrigerant goes through the respective stages to achieve the low temperature.

However, in the two-stage cascade mixed-refrigerant refrigeration circuit, since two compressors are separately installed in the respective high- and low-temperature side refrigeration circuits, consumption of electric power is increased and the structure of the refrigeration cycle thereof is complicated. In addition, in order to maintain the temperature in the refrigerating chamber at −152° C., it is necessary to continuously operate the refrigerator. However, it is difficult to operate continuously and stably the refrigerator since there is a problem in that residual oil which has been moved along with the refrigerant from the compressor to a low pressure side is not completely collected into the compressor to cause the lubricating oil to lack on sliding surfaces in the compressor and consequently a cylinder of the compressor to get scorched and stuck. Moreover, there are also problems in that suction pressure at low temperature is reduced and refrigeration performance is reduced.

DISCLOSURE OF INVENTION

An object of the present invention is to provide a refrigerating system which ensures reliability of the equipment thereof by maintaining stable performance even in case of continuous operation of the cryogenic refrigerating system.

Another object of the present invention is to provide a refrigerating system which improves life or reliability of the equipment thereof by ensuring the smooth operation of a compressor.

A further object of the present invention is to provide a refrigerating system which ensures external competitiveness of a product by enhancing the refrigeration efficiency thereof over 20% and stabilizing the operation thereof at ultra low temperature.

The above objects of the present invention can be achieved by a multi-stage expansion type of cryogenic refrigerating system, wherein a liquid refrigerant is expanded at an upper portion of an evaporated refrigerant carrying tube and is injected toward a downstream side with respect to a flow direction of evaporated refrigerant vapor in multiple stages so as to strongly draw refrigerant vapor in the evaporated refrigerant carrying tube and thus to lower evaporation pressure of the refrigerant below suction pressure of a compressor. Since the evaporated refrigerant vapor is strongly drawn and urged at a high velocity, flow velocity and pressure of the refrigerant vapor are increased and the suction pressure of the compressor is maintained over predetermined pressure. Accordingly, volumetric efficiency of the compressor can be improved and residual oil in a refrigeration circuit can be completely returned to the compressor. According to the present invention, it is possible to achieve final evaporation temperature of −160° C. and temperature of a refrigerating chamber of −156° C.

Further, the above objects of the present invention can be achieved by a multi-stage mixed-refrigerant system comprising a compressor for compressing a mixed-refrigerant; an oil separator for separating oil from the refrigerant compressed by the compressor, collecting the separated oil into the compressor, and then discharging the refrigerant; a condenser for cooling the high-temperature and high-pressure gaseous refrigerant discharged from the oil separator to liquefy the gaseous refrigerant; a heat exchanger which is installed on an evaporated refrigerant carrying tube for directing evaporated refrigerant vapor to the compressor in order to lower temperature of the condensed liquid refrigerant and in which the condensed high-temperature liquid refrigerant is caused to discharge heat therefrom to the evaporated low-temperature refrigerant vapor and to be supercooled, and the refrigerant flowed toward an inlet of the compressor is heated and evaporated; a gas/liquid separator for separating the condensed mixed-refrigerant passing through the heat exchanger into the liquid refrigerant and the gaseous refrigerant; a plurality of expansion/suction apparatuses; and a final evaporator.

In the expansion/suction apparatus, the liquid refrigerant separated by the gas/liquid separator sequentially passes through an expansion device installed in a tube, is injected from a nozzle provided on an end of the tube toward an outer tube for the evaporated refrigerant of a double tube, is evaporated while flowing from an upstream side to the downstream side, and communicates with an evaporated refrigerant carrying tube on a high-temperature side. At this time, a throttling phenomenon occurs in the vicinity of the nozzle and the refrigerant vapor in the evaporated refrigerant carrying tube is strongly drawn, so that the drawn refrigerant vapor is caused to flow into the outer tube of the double tube from the upstream side to the downstream side along with the injected refrigerant which has passed through the expansion device. At the same time, the residual oil contained in the refrigerant is moved toward the compressor, and an inner tube for the condensed refrigerant disposed inwardly from the outer tube for the evaporated refrigerant of the double tube which has two concentric tubes of different diameters directs the gaseous refrigerant separated by the gas/liquid separator in an upward direction, so that the gaseous refrigerant is condensed and the condensed refrigerant flows into a gas/liquid separator on the low temperature side. In such way, the liquid refrigerant from the gas/liquid separator passes through the expansion device and is injected from the nozzle, and then, the injected refrigerant is caused to flow together with the refrigerant vapor drawn due to the injection of the liquid refrigerant, toward the high temperature side along an evaporated refrigerant carrying tube on the high temperature side which communicates with the double tube. The gaseous refrigerant from the gas/liquid separator is condensed while flowing upwardly through the inner tube for the condensed refrigerant of the double tube, and then flows into the gas/liquid separator on the low temperature side. In such way, the expansion/suction apparatus constructs one cycle. The plurality of expansion/suction apparatuses are connected with each other in multiple stages so that the expansion and condensation of the refrigerant are repeated, thereby sequentially achieving low temperature.

In the final evaporator, condensed refrigerant which has passed through a final expansion/suction apparatus is condensed again in a heat exchanger disposed below the final evaporator, and flows into the final evaporator through an expansion device. The refrigerant introduced into the final evaporator is evaporated while flowing downwardly. The completely evaporated refrigerant flows into an evaporated refrigerant carrying tube of the final expansion/suction apparatus. Therefore, an integrated circuit is formed.

BEST MODE FOR CARRYING OUT THE INVENTION

According to a preferred embodiment of the present invention, the aforementioned expansion/suction apparatuses are connected in four serial stages between the heat exchanger on the high temperature side of the refrigerating system and the final evaporator on the ultra low temperature side thereof. In such a case, the refrigerant evaporating temperature became ultra low temperature of −160° C. (at this time, the temperature in the refrigerating chamber became −156° C.).

Hereinafter, a preferred embodiment of the present invention will be described in detail with reference to the accompanying drawings. However, it is merely intended to specifically illustrate the present invention to such an extent that a person having ordinary knowledge in the art to which the present invention pertains can easily work the present invention. Accordingly, it should not be construed that the technical spirit and scope of the present invention are limited thereto.

Figure 1:
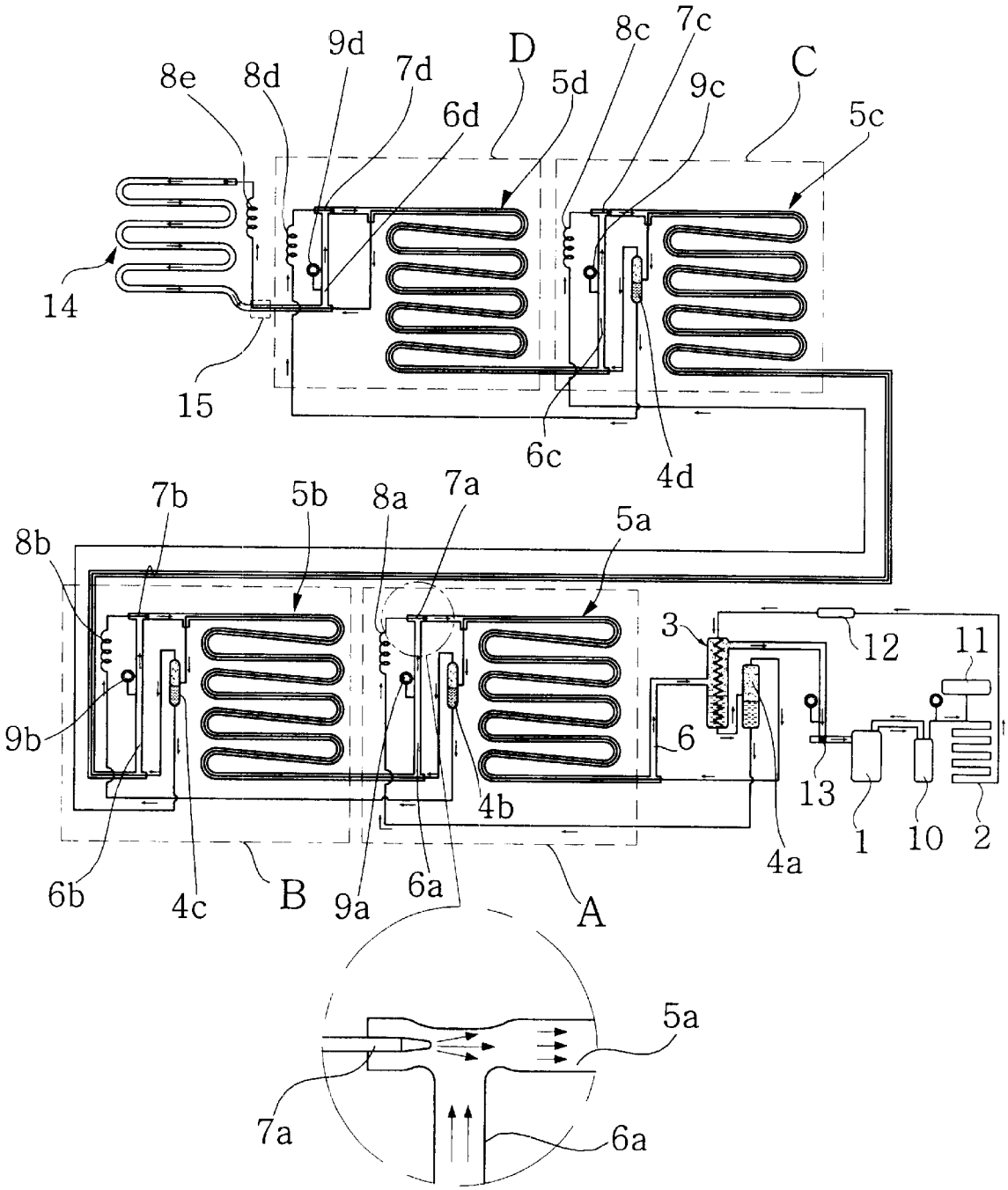
FIG. 1 is a schematic circuit diagram of a cryogenic refrigerating system according to the present invention.
Figure 2:
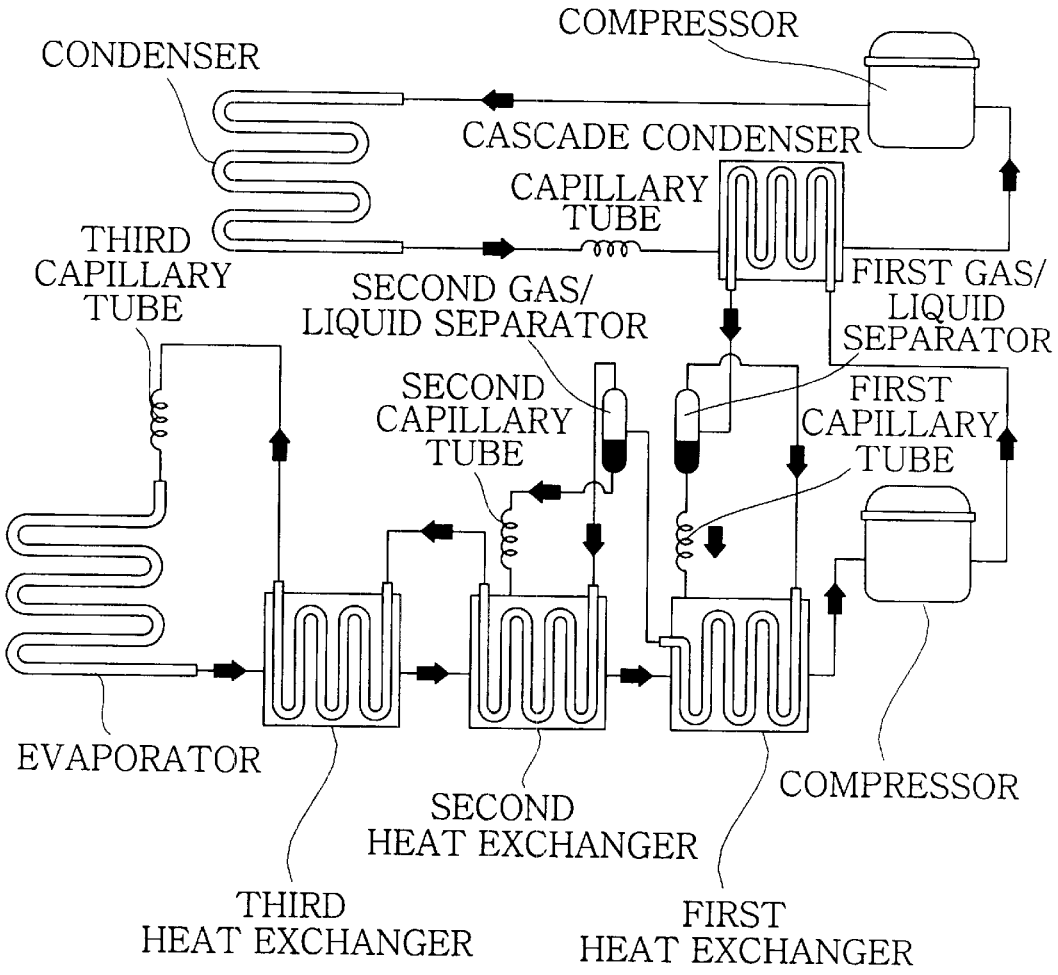
FIG.2 PRIOR ART
FIG. 2 is a schematic circuit diagram of a cryogenic refrigerating system according to the prior art.

As shown in FIG. 1, a cryogenic refrigerating system according to a preferred embodiment of the present invention comprises a compressor 1 for compressing a mixed-refrigerant; a condenser 2 for liquefying high temperature and high pressure refrigerant vapor compressed by the compressor 1 (among the mixed-refrigerant, a refrigerant having a high boiling point is liquefied); and an oil separator 10 installed between tubes for the compressor 1 and the condenser to separate oil from the compressed refrigerant and return the oil to the compressor 1.

The cryogenic refrigerating system of the present invention further comprises a heat exchanger 3 which is installed between an evaporated refrigerant carrying tube 6 and a suction portion of the compressor 1, causes the refrigerant condensed in the condenser to be supercooled and flowed to a first gas/liquid separator 4*a*, and causes refrigerant vapor to be heated for forming dry saturated vapor and moved to the compressor; and a filter dryer 12 disposed between tubes for the condenser 2 and the heat exchanger 3 for removing moisture and foreign material contained in the refrigerant.

The cryogenic refrigerating system of the present invention further comprises the first gas/liquid separator 4*a* for separating the condensed mixed-refrigerant, which has passed through the heat exchanger 3 and has been supercooled, into a liquid refrigerant and a gaseous refrigerant, and a first expansion device 8*a* for reducing the pressure of liquid refrigerant separated by the first separator 4*a* to its own evaporation pressure.

The refrigerant which has passed through the first expansion device 8*a* is injected from an upstream side to a downstream side toward a double tube communicating with the evaporated refrigerant carrying tube 6*a* by means of a nozzle 7*a* that is installed in a converging and diverging side end of a tube for the evaporated refrigerant located at a portion communicating with the evaporated refrigerant carrying tube 6*a*. At this time, a throttling phenomenon occurs due to the injection of the refrigerant, and thus, the pressure in the evaporated refrigerant carrying tube 6*a* is greatly reduced. Consequently, the refrigerant vapor in the evaporated refrigerant carrying tube 6*a* is strongly drawn, and the refrigerant injected at a high speed through the first expansion device 8*a* and the nozzle 7*a* flows fast from the upstream side to the downstream side along the tube for the evaporated refrigerant, i e an outer tube of the double tube, together with the drawn refrigerant vapor. Accordingly, a predetermined velocity of the refrigerant is ensured, and perfect oil recovery is made since residual oil contained in the refrigerant moves toward the compressor. As a result, high efficiency and safety of the refrigerating system according to present invention is guaranteed. At the same time, the gaseous refrigerant from the first gas/liquid separator 4*a* on the high temperature side of the refrigerating system is condensed while flowing upwardly along a tube for the condensed refrigerant, and is then introduced into a gas/liquid separator 4*b* on the low temperature side of the refrigerating system.

Preferably, the expansion/suction apparatuses in which the gaseous and liquid refrigerants from the gas/liquid separator flow in the opposite directions are repeatedly constructed in multiple stages toward the low temperature side of the refrigerating system.

That is, according to the preferred embodiment of the present invention, the expansion/suction apparatuses A to D, which are constructed in such a manner that the evaporated refrigerant vapor flows toward the high temperature side of the refrigerating system and the condensed refrigerant liquid flows toward the low temperature side of the refrigerating system, are connected in series with one another. Thus, the temperature of the condensed refrigerant flowing out from the expansion/suction apparatus becomes lower as the refrigerant advances toward the low temperature side of the refrigerating system. The condensed refrigerant which has passed through the final expansion/suction apparatus D is condensed again in a heat exchanger 15, flows through a final expansion device 8*e*, is introduced into an upper portion of a final evaporator 14, and then flows through the final evaporator downwardly. At this time, the condensed refrigerant is evaporated and absorbs heat from the refrigerating chamber. Thus, the ultra low temperature of −160° C. (temperature in the refrigerating chamber: −160° C.) has been obtained. Since the completely evaporated refrigerant flows into an evaporated refrigerant carrying tube 6*d* of the final expansion/suction apparatus through the outer tube of the double tube located below the evaporator 14, the cryogenic refrigerating system with an integrated circuit formed therein is constructed.

The reference numeral 11, which has not yet been explained, denotes an expansion tank for storing highly increased pressure produced at the time of initial operation of the compressor 1; the reference numeral 13 denotes a suction pressure regulating valve for performing overload control when the overload occurs at a suction portion of the compressor 1; and the reference numerals 9*a* to 9*d* denote pressure gauges for indicating the pressure of the refrigerant flowing through the relevant evaporated refrigerant carrying tubes.

As described above, even though a multi-stage system in which the expansion/suction apparatuses A to D are connected in series with one another in order to obtain the ultra low temperature of −160° C. is constructed, there is still limitation on achievable ultra low temperature. Therefore, the present invention intends to employ a refrigerating system in which a mixed-refrigerant is used. The mixed-refrigerant in the expansion/suction apparatus complicatedly behaves within the refrigeration circuit when the refrigerator actually operates. The ultra low temperature is obtained according to the liquefaction/evaporation processes to be roughly described below.

Since the refrigeration circuit on the high temperature side of the refrigerating system is well known, the description thereof will be omitted. Thus, the operation of each expansion/suction apparatus on the low temperature side of the refrigerating system will be described below.

In the expansion/suction apparatus A, the liquid refrigerant R-600A from the first gas/liquid separator 4*a* is evaporated. At this time, the pressure of the evaporated refrigerant in the evaporated refrigerant carrying tube 6*a* is approximately −18 cmHg, and the temperature of the refrigerant flowing through the injection nozzle 7*a* is approximately −62° C.

In the expansion/suction apparatus B, the liquid refrigerants R-22, R-290 from the gas/liquid separator 4*b* of the expansion/suction apparatus A are evaporated. At this time, the pressure of the evaporated refrigerant in the evaporated refrigerant carrying tube 6*b* is approximately −28 cmHg, and the temperature of the refrigerant flowing through the injection nozzle 7*b* is approximately −119° C.

In the expansion/suction apparatus C, the liquid refrigerants R-116, R-23 from the gas/liquid separator 4*c* of the expansion/suction apparatus B are evaporated. At this time, the pressure of the evaporated refrigerant in the evaporated refrigerant carrying tube 6*c* is approximately −35 cmHg, the temperature of the refrigerant flowing through the injection nozzle 7*c* is approximately −136° C., and the temperature of the refrigerant heat-exchanged at the double tube 5*c* is approximately around −128° C.

In the expansion/suction apparatus D, the liquid refrigerants R-1150, R-14 from the gas/liquid separator 4*d* of the expansion/suction apparatus C are evaporated. At this time, the pressure of the evaporated refrigerant in the evaporated refrigerant carrying tube 6*d* is approximately −45 cmHg, the temperature of the refrigerant flowing through the injection nozzle 7*d* is approximately −152° C., and the temperature of the refrigerant which has heat-exchanged at the double tube 5*d* is about −147° C.

The refrigerant that will be evaporated in the final evaporator 14 is a liquid refrigerant R-50 (in which He, Ar, or the like can be added) from the expansion/suction apparatus D. The refrigerant is supercooled again while flowing through the heat exchanger 15 made of the double tube and located below the final evaporator. Thus, the temperature of the refrigerant becomes −153° C. Thereafter, the evaporated refrigerant is introduced into the evaporator via the expansion device 8*e*. At this time, the temperature of the refrigerant at an inlet of the evaporator 14 is −160° C., and the temperature of the refrigerant at an outlet of the evaporator is −154° C. Accordingly, the ultra low temperature of −156° C. is obtained as a temperature within the refrigerating chamber.

Further, when the refrigerant separated by the relevant separator is injected from each of the injection nozzles 7*a* to 7*d* at the relevant stage, the Bernoulli's principle is applied to a process of drawing the evaporated refrigerant vapor from each of the evaporated refrigerant carrying tubes 6*a* to

6*d,* and expanding and transferring the injected refrigerant together with the drawn refrigerant toward each of the double tubes 5*a* to 5*d*. Thus, the suction pressure of the compressor becomes as strong as the pressure value of each of the pressure gauges 9*a* to 9*d* installed on the evaporated refrigerant carrying tubes. Accordingly, the problems that the refrigerant evaporating temperature is increased and refrigeration performance is reduced due to reduction of the suction pressure are overcome.

Industrial Applicability

As described above, according to the present invention, the evaporation pressure of the refrigerant is kept below the suction pressure of the compressor of the refrigerator, and thus, the stable performance of the refrigerating system can be maintained even in case of continuous operation of the refrigerating system under the maximum temperature condition.

Further, the pressure and the flow velocity of the refrigerant drawn toward the high pressure side can be increased at the respective stages by using the throttling phenomenon, so that the residual oil on the low pressure side can be completely collected into the compressor. Thus, the smooth operation of the compressor can be ensured and the usable life and reliability of the equipment of the refrigerating system can be improved.

Moreover, since the liquid refrigerant is injected from the nozzle toward the end of the evaporated refrigerant carrying tube, the throttling phenomenon occurs. The suction force generated as such strongly draws upwardly the refrigerant vapor, and thus, the stable flow of the refrigerant can be obtained. Consequently, the usable life of the equipment is prolonged, and at the same time, the refrigeration efficiency can be improved over 20% in the art.

According to the present invention, there is an advantage in that the multi-stage expansion compressor type refrigerator can be continuously and stably maintained at the temperature of −156° C.

What is claimed is:

1. A multi-stage mixed-refrigerant type cryogenic refrigerating system including a compressor (1) for compressing a mixed-refrigerant drawn thereinto, an oil separator (10) for separating oil contained in the refrigerant compressed by the compressor, a condenser (2) for liquefying refrigerant vapor discharged from the oil separator, a heat exchanger (3) for heating evaporated refrigerant vapor introduced after circulating through a low-temperature side refrigeration cycle to be further evaporated and for supercooling the refrigerant condensed by the condenser (2), a first gas/liquid separator (4*a*) for separating the supercooled mixed-refrigerant into a liquid refrigerant and a gaseous refrigerant, and a final evaporator for evaporating the refrigerant to be returned to the compressor (1), the refrigerating system further comprising:

a plurality of expansion/suction apparatuses connected with one another in series, wherein each expansion/suction apparatus is constructed such that a liquid mixed-refrigerant from the first gas/liquid separator (4*a*) passes through an expansion device (8*a*) and is then injected from an injection nozzle (7*a*) installed on a side end of an evaporated refrigerant carrying tube (6*a*) into an outer tube of a double tube so that the injected refrigerant is evaporated while flowing downwardly and then flows into an evaporated refrigerant carrying tube (6) on a high temperature side, and a gaseous mixed-refrigerant discharged from the first gas/liquid separator (4*a*) flows upwardly through an inner tube for the condensed refrigerant of the double tube (5*a*) to be condensed and is then introduced into a second gas/liquid separator (4*b*); and wherein the refrigerant condensed by passing through a final expansion/suction apparatus D is introduced into a fifth expansion device (8*e*) through a heat exchanger disposed below the final evaporator, the refrigerant introduced into the evaporator (14) is evaporated, and the completely evaporated refrigerant is returned to the compressor (1) through a tube for the evaporated refrigerant communicating with the evaporated refrigerant carrying tube, whereby a refrigerant circuit of the refrigerating system is formed.

2. The cryogenic refrigerating system as claimed in claim 1, wherein four expansion/suction apparatuses are connected with one another in series between the heat exchanger on the high temperature side and the evaporator on an ultra low temperature side.

3. The cryogenic refrigerating system as claimed in claim 1, wherein the injection nozzle is installed at a narrow end of the tube for the evaporated refrigerant communicating with the evaporated refrigerant carrying tube.

* * * * *